US007293635B2

(12) United States Patent
Repke et al.

(10) Patent No.: US 7,293,635 B2
(45) Date of Patent: Nov. 13, 2007

(54) BUSINESS TRAVEL BAG

(75) Inventors: Mary E. Repke, Morristown, NJ (US); Lois Zaprzalka Sherr, New York, NY (US)

(73) Assignee: Coakley Business Class, LLC, Morristown, NJ (US)

( * ) Notice: Subject to any disclaimer, the term of this patent is extended or adjusted under 35 U.S.C. 154(b) by 0 days.

(21) Appl. No.: 11/264,528

(22) Filed: Nov. 1, 2005

(65) Prior Publication Data

US 2006/0090823 A1 May 4, 2006

Related U.S. Application Data

(63) Continuation-in-part of application No. 10/980,018, filed on Nov. 3, 2004, now abandoned.

(51) Int. Cl.
*A45C 3/02* (2006.01)
*A45C 5/06* (2006.01)
*A45C 13/10* (2006.01)

(52) U.S. Cl. ..... 190/109; 190/110; 190/111; 190/119; 190/902; 206/320

(58) Field of Classification Search ..... 190/39, 190/109–111, 902, 903, 103, 114, 122, 113; 206/320, 816, 576; 150/143; 383/62, 63; 220/345.1, 350

See application file for complete search history.

(56) References Cited

U.S. PATENT DOCUMENTS 1,359,461 A * 11/1920 Luce ..... 383/15
1,437,565 A * 12/1922 Stein et al. ..... 190/103
1,710,582 A * 4/1929 Lifton ..... 190/109
2,053,599 A * 9/1936 Brinkerhoff ..... 150/117
2,104,935 A * 1/1938 Solomon ..... 190/109
2,249,905 A * 7/1941 Lifton ..... 190/109
2,555,705 A * 6/1951 Schafer ..... 220/348
2,648,412 A * 8/1953 Meyers ..... 190/119
2,839,114 A * 6/1958 Moscowitz et al. ..... 150/138
3,137,374 A * 6/1964 Holtzman ..... 190/110
3,354,925 A * 11/1967 Doppelt ..... 150/108
3,559,798 A * 2/1971 Jacobsen ..... 206/5
3,648,412 A * 3/1972 Hathaway ..... 451/59

(Continued)

FOREIGN PATENT DOCUMENTS

EP 1475008 A1 * 11/2004

(Continued)

*Primary Examiner*—Sue A. Weaver
(74) *Attorney, Agent, or Firm*—Patricia M. Mathers

(57) ABSTRACT

Travel bag for organizing computer and other items has a computer compartment that includes pockets for small items and a dual-entry pocket. Flat pockets are provided on two large sides of the dual-entry pocket. An opening on the outer body of the bag provides access to contents of the dual-entry pocket and flat pockets. The flat pockets are made of elastic material for securely holding small items and devices that are frequently retrieved, such as cell phone, travel tickets, sunglasses, etc. A briefcase style includes a retractable flap that covers the top of the bag and slides down into the bag to provide unfettered access to contents. A tote style has deep pockets in expandable side gussets, for holding water bottle, umbrella, shoes, etc. Straps are rope-filled tubular leather. A cord kit, a tool kit, and a purse may be included.

15 Claims, 5 Drawing Sheets

U.S. PATENT DOCUMENTS

| | | | | |
|---|---|---|---|---|
| 3,963,102 | A | | 6/1976 | Carp |
| 4,161,201 | A | * | 7/1979 | Carp ..... 190/110 |
| 4,696,077 | A | * | 9/1987 | Kim ..... 16/114.1 |
| 4,733,759 | A | * | 3/1988 | Shih-Chen ..... 190/18 A |
| 4,854,432 | A | * | 8/1989 | Carpenter et al. ..... 190/110 |
| 5,105,920 | A | * | 4/1992 | Grebenstein ..... 190/18 A |
| 5,217,119 | A | | 6/1993 | Hollingsworth |
| D345,651 | S | | 4/1994 | Copp |
| 5,324,115 | A | * | 6/1994 | Weinreb ..... 383/2 |
| 5,394,964 | A | | 3/1995 | White |
| 5,775,497 | A | * | 7/1998 | Krulik ..... 206/320 |
| 5,808,865 | A | * | 9/1998 | Alves ..... 361/685 |
| 5,829,502 | A | | 11/1998 | Distefano et al. |
| 6,047,752 | A | | 4/2000 | Southwick |
| 6,059,079 | A | * | 5/2000 | Krulik ..... 190/112 |
| 6,105,763 | A | * | 8/2000 | Saetia ..... 206/320 |
| 6,105,764 | A | | 8/2000 | Scicluna et al. |
| 6,179,025 | B1 | | 1/2001 | Sutton |
| 6,237,766 | B1 | | 5/2001 | Hollingsworth |
| 6,257,381 | B1 | | 7/2001 | Harfst |
| D446,644 | S | | 8/2001 | Tucker |
| 6,283,183 | B1 | | 9/2001 | Cooper |
| D455,262 | S | * | 4/2002 | Krulik ..... D3/279 |
| D463,118 | S | | 9/2002 | Tucker |
| 6,446,688 | B1 | | 9/2002 | Sutton |
| 6,460,668 | B1 | * | 10/2002 | Godshaw et al. ..... 190/18 A |
| 6,491,074 | B1 | * | 12/2002 | Roegner ..... 150/112 |
| 6,508,358 | B2 | * | 1/2003 | Cheng ..... 206/315.1 |
| 6,516,927 | B2 | * | 2/2003 | Krulik ..... 190/114 |
| 6,561,240 | B2 | | 5/2003 | Ma |
| 6,581,736 | B1 | | 6/2003 | Scicluna |
| 6,595,358 | B1 | * | 7/2003 | Speck ..... 206/315.9 |
| 6,637,484 | B1 | | 10/2003 | Kraft |
| 7,036,642 | B2 | * | 5/2006 | Hoberman et al. ..... 190/36 |
| 2003/0146120 | A1 | * | 8/2003 | Chi ..... 206/315.5 |
| 2004/0085694 | A1 | * | 5/2004 | Germagian et al. ..... 361/90 |
| 2004/0134813 | A1 | * | 7/2004 | Domotor ..... 206/320 |

FOREIGN PATENT DOCUMENTS

| | | | |
|---|---|---|---|
| WO | WO 03/007748 | A1 * | 1/2003 |

* cited by examiner

BUSINESS TRAVEL BAG

This application is a Continuation-in-Part of U.S. patent application Ser. No. 10/980,018, filed on Nov. 3, 2004, now abandoned, and claims domestic priority under 35 U.S.C. § 120 therefrom.

BACKGROUND INFORMATION

1. Field of the Invention

The invention relates to the field of briefcases and other protective hand-carried cases or bags. More particularly, the invention relates to a travel bag that is adapted to neatly organize and securely carry a laptop and other small electronic devices and business materials, as well as a purse or hand bag for personal items, and is attractive in appearance.

2. Description of the Prior Art

The business person today, when going to a meeting, must frequency carry along a number of items, such as a laptop computer, a personal digital assistant (PDA), a cell phone, plus paper files. Often the person has to travel to a distant location for the meeting, which means that personal items must also be carried along. Today, due to stringent security restrictions on airline travel, a traveler is limited to two carry-on items: one carry-on size piece of luggage and one personal item. Typically, the traveling business person wants to avoid having to check luggage to save time and, thus, wants to carry onto the plane the one piece of carry-on luggage plus a single bag that contains all necessary business items and artifacts. The situation is more complicated for a businesswoman, who, in addition to the typical tools of the business world mentioned above, also typically carries a purse or handbag, which contains small personal items, such as wallet, keys, glasses, and personal care and cosmetic items. The new regulations count a purse as the one personal item the traveler is allowed to bring onboard, so the business woman today has to check what normally would be allowed as carry-on luggage, if she wants to carry a briefcase/laptop case and a purse on board.

A solution to this problem is to carry a bag that fits within the security regulations as a carry-on bag, and combines the features of a well-organized computer carrycase with storage area for personal artifacts. Numerous computer carry bags and tote bags are available. None of the conventional bags, however, provides the degree of protection for electronic devices and files, while simultaneously providing the storage space and organization for myriad other accessories, such as power cords and chargers, PC and office supplies, as well as the personal items a businesswoman typically carries with her. Many tote bags are open at the top, exposing the contents to the weather and the view of other parties, and also making it easier for a thief to lift articles from the bag if it is left unguarded for only very brief moments. A critical disadvantage of the conventional tote bag is that it does not provide the organizational functionality desired for neatly and conveniently storing the artifacts and devices required in the course of business, because it has an open bucket design with very few pockets, if any at all. Such tote bags make it difficult to maintain a system of ordering the items for convenient retrieval. Heavy items, such as keys and mobile phones, invariably sink to the bottom, and within a short period of time, papers float about loosely and the items are hopelessly jumbled and difficult to retrieve quickly. Tote bags generally detract from the look that a professional and successful businesswoman wishes to convey, and many of them are difficult to carry, with straps that slip off the shoulder.

Other bags or cases for computers, particularly those in the briefcase style, provide a secure enclosure for a computer and other articles, but make it difficult to quickly and easily gain access to some of the articles, without first having to set the case down in order to open it up. Having to set the case down in order to open it also puts the person carrying it into a more vulnerable position, because the case is now separated from the person and open, restricting the ability of the person to move away from an unpleasant situation without giving up control of the case. This is particularly true of such computer bags with a hinged two-part body that must be unlocked or released, and the upper part then lifted to expose the articles therewithin. Security checks at an airport now regularly require that a laptop be removed from its carrying case for inspection. This increases the need for a carrying case that allows one to quickly and easily remove the laptop for an airport security check, and just as quickly and easily replace it once cleared through security. The functional structure of the briefcase has not changed in over 30 years and it fails to address the need to organize electronic devices and accessories, and business and personal articles.

What is needed, therefore, is a travel bag particularly geared to the needs of the business traveler, that will neatly and securely store electronic devices, and provide storage area for business and personal items. What is further needed is such a travel bag that enables the user to organize all necessary devices and articles, and yet provides easy access to selected areas. What is yet further needed is such a travel bag that is comfortable to carry, protects the contents of the bag from the weather, and is fashionably attractive.

BRIEF SUMMARY OF THE INVENTION

For the reasons cited above, it is an object of the present invention to provide a business travel bag that combines the easy access provided by the conventional open tote bag with the security provided by the conventional briefcase. It is a further object to provide such a travel bag that allows practical and convenient organization of items stowed within the bag, and yet allows quick and easy retrieval of selected items. It is a yet further object to provide such a travel bag that has the aesthetic and fashionable appeal desired by the successful businessperson.

The objects of the invention are achieved by providing a travel bag comprising a computer compartment, a plurality of pockets for securing handheld electronic devices and various other small items, and storage area for various bulky articles, such as a purse or handbag, power cords and office supplies, water bottle, books, magazines, umbrella, or shoes. The body of the travel bag according to the invention may be constructed in several styles, such as a briefcase or a tote bag, and, as used hereinafter, the simple term "body" encompasses both the briefcase and the tote bag, as well as other styles. The body, which includes an outer body and a lining, is generally rectangular in shape, has a front wall, a rear wall, two side walls, and a bottom; the primary access into the tote bag is from the top. A primary access closure means may be provided to close the top of the body. The type of closure means provided may vary according to the particular style of the travel bag. For example, the primary closure means on a briefcase style may be a flap that extends from the back wall across the top of the travel bag to the front wall and is secured with snaps, magnetic snaps, buckles, fabric hook-and-loop strips, etc. The flap may be retractable, being stowed in a space provided on the rear wall when not in use. The primary closure means for a tote bag style may be a fabric flap with a zipper that closes off the top of the bag or a magnet closure that holds the upper edges of the front and rear walls together. The outer body of the travel bag according to the invention may be made of any number of materials, such as canvas, leather, synthetic materials, including microfibers, other rugged and durable materials, or combinations thereof. The lining is ideally made of a supple, tear-resistant, water-repellent and mildew-resistant fabric.

The computer compartment is provided along the inner surface of one wall, either the front or rear wall, of the travel bag. For ease of description, the computer compartment will be described herein as being placed along the rear wall. The compartment is padded with a shock-absorption means, has elastic side gussets and a compartment closure means that closes the top of the compartment as desired. The elastic side gussets and padding allow the computer compartment to accommodate the varying dimensions of a conventional laptop, yet snugly hold the laptop and protect it from impact shock. The compartment closure means is provided as additional security to protect the computer from slipping out of the compartment if the travel bag is inadvertently turned upside down, dropped, or falls over, and also makes it more difficult for an unauthorized person to extract the computer from the travel bag without notice. Compartment closure means that are suitable for securing the computer compartment include a fabric panel that is secured to the compartment with a zipper, snaps, magnetic snaps, hook-and-loop fabric strips, buckles, etc. One or more pockets are provided on a surface of the computer compartment that faces the central area of the travel bag, to hold pens, business cards, and other small items.

It is sometimes desirable to access the internal storage area of a bag "on the fly", that is, without first putting the bag down and gaining access through the primary access at the top of the tote bag. For this reason, a dual-entry pocket is provided along the front wall of the travel bag, i.e., the wall opposite the computer compartment. The dual-entry pocket is a large enclosed, rectangular pocket formed from two pocket faces that are joined to each other along all four edges. Access to the dual-entry pocket is provided through openings, such as zippers, that are provided on each face. An opening or secondary access through the front wall of the outer body allows access to the dual-entry pocket from the front wall. The faces of the pockets are ideally constructed of a piece of material, folded over and stitched around three sides to form the enclosed pocket area. A first face of the dual-entry pocket faces the interior of the travel bag, the second face faces the front wall of the outer body. Arranged on the first face is a first flat pocket or pockets, and on the second face, a second flat pocket or pockets. The second flat pocket or pockets are readily accessible through the secondary access in the front wall. It may be desirable to provide the first and/or second flat pocket or pockets correspondingly as a first and/or second series of three or four pockets of varying sizes, to accommodate specific items. The first series of flat pockets is well-suited to organize and hold, for example, electronic devices and other small items and accessories, such as a PDA, CDs or diskettes, reading glasses, business card holders, and personal items, such as makeup or a hairbrush. The second series of pockets, which is the series closest to the outer body wall, is best-suited to hold in an organized manner electronic devices and small items that are necessarily frequently retrieved from the bag during travel. Examples of such devices and items include a cell phone, travel tickets and passport, and sunglasses. Ideally, in order to securely hold such items, which vary in shape and dimension, these flat pockets are made of heavy-duty stretch fabric that is sturdy, yet sufficiently elastic to securely hold the intended items. An example of such stretch fabric that is suitable for the flat pocket or pockets is nylon-covered material of polychloroprene (CR) synthetic rubber. One particularly suitable type of CR rubber is neoprene DA 25, which has been used for the top body of shoes, sports accessories such as wearable CD player holders and CD organizers for cars. The stretch fabric is rugged and the elasticity such that a cell phone, a PDA, or a pair of eyeglasses is held securely in the pocket and will not, under normal conditions of use, inadvertently slip out of the pocket.

The travel bag according to the invention further comprises a cord kit and/or a tool kit, both of which may be stored in the relatively spacious interior storage area between the computer compartment and the dual-entry pocket. These kits are provided for neatly and securely storing cords, surplus batteries, a wireless mouse and other accessories for the various electronic devices, a collection of tools, such as drawing utensils and/or office products, or make-up. Each kit is ideally made of a sturdy fabric or leather with a zipper opening that provides easy access to the contents. In addition to the kits, a small purse or clutch-style handbag is provided that folds flat when not in use, but is adequate in size to store a checkbook size wallet or credit card etui, a few small personal or cosmetic articles, keys, a cell phone, etc. This purse is made of a fabric or leather that is aesthetically pleasing to the eye and the touch.

The travel bag according to the invention that is fashioned as and hereinafter referred to as a "briefcase" has a briefcase body that is sturdy and rugged, with front, rear and side walls that have sufficient rigidity to stand upright. A zippered central pocket is provided between the rear wall with the computer compartment and the front wall with the dual-entry pockets. Extending across the top of the body is a retractable security flap, which, when opened, slides down into a pocket space provided for it between the outer rear wall and the computer compartment. The flap is secured to the front wall by some suitable closure means, such means encompassing zippers, snaps, magnetic snaps, buckles, and hook-and-loop fabric strips. A sleeve is provided on the outside of the rear wall for the purpose of sliding the briefcase over the pull-out handle of a conventional piece of carry-on-size wheeled luggage, thereby allowing the user to conveniently and securely stow the briefcase with the luggage. When placed on the luggage handle in this manner, the front wall of the briefcase, along with the dual-entry pocket, is readily accessible, without having to remove the briefcase from the luggage handle.

The travel bag according to the invention that is fashioned as, and is hereinafter referred to as, a "tote bag" has a soft outer body with expandable side gussets in the side walls. The tote bag includes the computer compartment, the dual-entry pocket, and the flat pockets described above, and further has deep pockets for stowing an umbrella, a water bottle, shoes, books, magazines, etc. In order to keep the tote bag as compact as possible, the expandable gussets fold in and are secured in place when not needed with magnets or snaps, or some other suitable fastener means. This shortens the overall length of the tote bag by several inches. The straps or handles of the tote bag are placed at the outer corners of the body as defined with the expandable gussets folded in. This placement of the straps provides improved balance of the bag when it is fully loaded.

The deep pockets, dimensioned to easily hold an umbrella, a water bottle, shoes, and other large bulky items, are formed in the expandable gusset areas by a deep-pocket wall that is a piece of fabric that extends from the front wall to the rear wall of the lining on the body of the tote bag. The deep-pocket wall is attached with a zipper to one or the other wall. If a larger, uninterrupted storage area is needed, the zipper is unzipped and the deep-pocket wall folded out of the way. One or more pockets for holding small items, such as keys, are provided on the deep-pocket wall.

The rear wall of the outer body of the tote bag has a sleeve-pocket with zippers along the top and bottom edges, allowing it to serve as a secured pocket or, when unzipped on both edges, as a sleeve for securing the tote bag on the pulled-out handle of a wheeled, carry-on luggage. The front wall of the outer body has an open pocket that extends across the front wall between the straps. The inner wall of the open pocket has a zipper in it that provides access to the dual-entry pocket.

Attractive and sturdy handles or straps that are adjustable in length are attached to the travel bag so that it may be carried as a shoulder bag or as a tote. To provide greater comfort, the straps may be rope-filled tubular leather straps. The straps may be attached to secondary straps that may be stitched onto the body, that is, down the front and rear walls and across the bottom of the body. This provides greater support for weight and reduces wear and tear on the straps.

Various other features that may be provided on the travel bag according to the invention include grommets or "feet" on the bottom of the travel bag and tabs provided on one or the other interior wall or on a pocket for securing key chains. Other features and elements of the travel bag according to the invention are disclosed in the drawings and the detailed description below.

BRIEF DESCRIPTION OF THE DRAWINGS

The present invention is described with reference to the accompanying drawings. In the drawings, like reference numbers indicate identical or functionally similar elements.

FIG. 9 is an illustration of the travel bag as a tote bag, with the expandable gussets folded in.

DETAILED DESCRIPTION OF THE INVENTION

Figure 1:
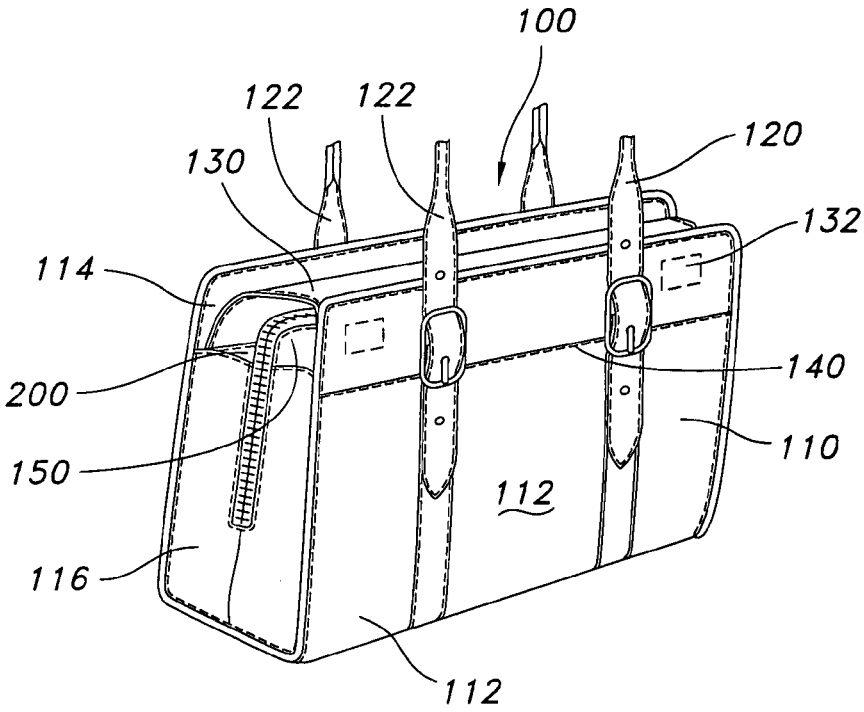
FIG. 1 is a perspective view of a briefcase style of the travel bag according to the invention.
Figure 2:
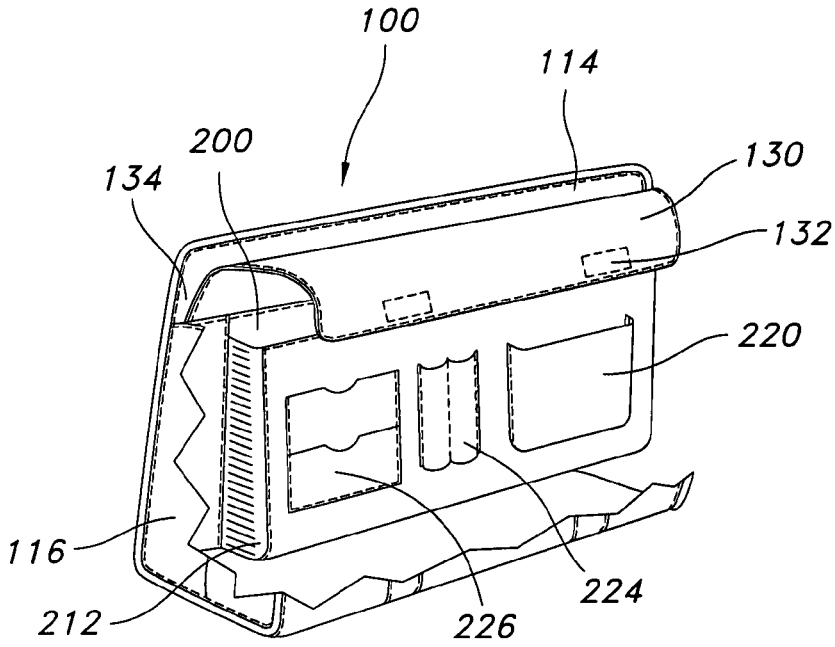
FIG. 2 is a cut-away perspective view of the travel bag, showing the computer compartment and retractable flap.
Figure 4:
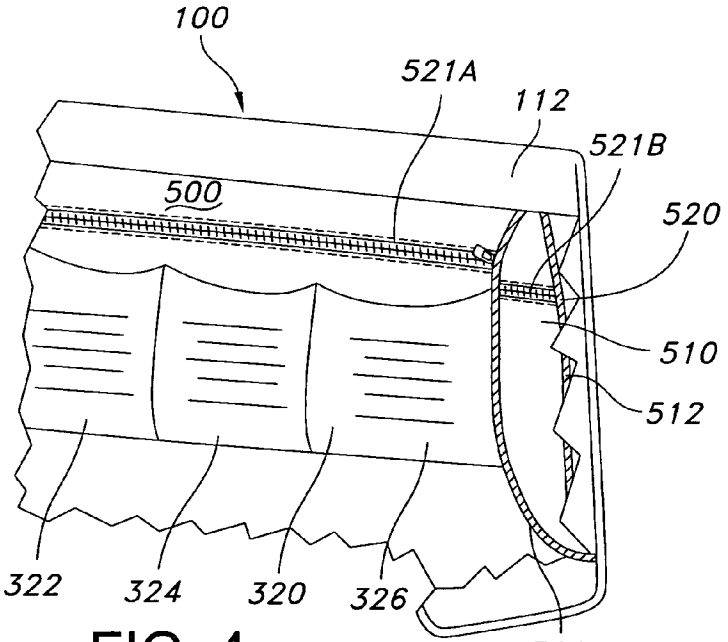
FIG. 4 is a cut-away perspective view of the front wall of the travel bag, showing a dual-entry pocket and a first series of flat pockets.
Figure 5:
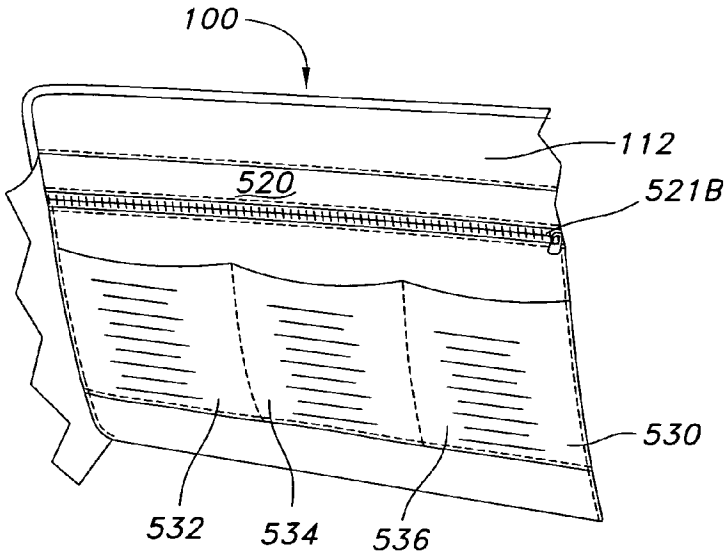
FIG. 5 is a cut-away plane view of the front wall of the travel bag, showing a second series of flat pockets on the dual-entry pocket.
Figure 3:
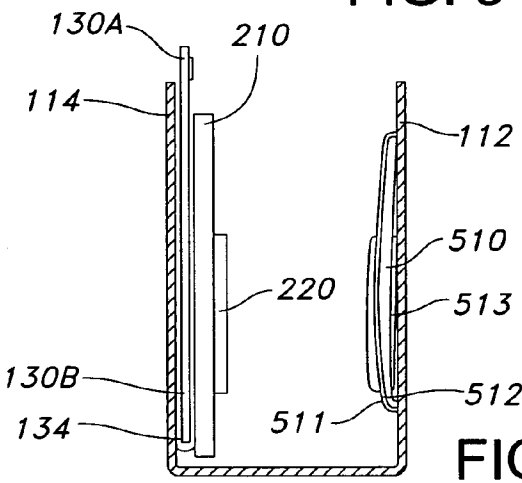
FIG. 3 is a cross-sectional side view of the travel bag, showing the retractable flap storage space, the computer compartment, and the dual-entry pocket.

FIGS. 1-6 illustrate a a first embodiment of a travel bag 100 according to the invention, which is a briefcase. FIG. 1 is a perspective view of the travel bag 100, closed, illustrating primarily the outer structure of the travel bag. FIGS. 2 and 3 are cut-away perspective views that illustrate various internal features of the travel bag 100, and FIG. 5 illustrates a preferred configuration of internal features of the travel bag 100. The travel bag 100 comprises a body 110 that includes a front wall 112, a rear wall 114, and side walls 116, a retractable flap 130, and a carrying means 120. The travel bag 100 is lined with a fabric lining 500, that is supple and preferably light in color.

FIG. 2 illustrates a computer compartment 200 provided along the rear wall 114 for securely holding a laptop computer. The computer compartment 200 is formed by a compartment wall 210 that runs parallel to the rear wall 114 and compartment side gussets 212. The side gussets 212 are made of a heavy-duty elastic material, such as a nylon-covered neoprene stretch fabric. The computer compartment 200 is provided with a shock-attenuation means (not shown) to protect the computer. Such means include foam padding or air cushioning. A plurality of pockets 220 are provided on the compartment wall 210 for storing various articles. In the particular embodiment shown, the pockets 220 include a writing utensil pocket 224, business cards and/or diskette storage pocket 226, and a fiat pocket for CD's or a PDA. The configuration and shape of these pockets are provided as an illustration only of the various types of pockets 220 that may be included in the travel bag 100 according to the invention and not intended to be a limitation of the scope of the invention.

FIG. 3 shows a flap storage space 134 that is provided between the rear wall 110 and the computer compartment 200 for slidably receiving the retractable flap 130 and shows the flap 130 retracted into the flap storage space 134. The flap 130 includes a flap portion 130A that, when closed, extends over the top of the travel bag 100 and is securable against the front wall 112, and a extension portion 130B that is slidably secured in the flap storage space 134. FIGS. 1 and 2 show the retractable flap pulled out and attached to the inner surface of the front wall 112 with a flap closure means 132. In the embodiment shown, the flap closure means 132 is a plurality of magnetic snaps. The flap closure means 132 is shown as magnetic snaps for illustration purposes only and is not intended to be limiting. Many suitable closures exist, such as interference-fit snaps, fabric hook-and-loop strips, button-and-slot means, zippers, etc. Ideally, the flap closure means 132 includes a series of closures that allow the flap to close in different positions, in order to securely close the travel bag 100 under various load conditions: very full, not so full, etc.

FIG. 4 is a partial cut-away view of the travel bag 100, with a cross-sectional illustration a dual-entry pocket 520 that is provided on the front wall 112 of the travel bag 100 according to the invention. The dual-entry pocket 520 has an exterior lining wall 512, an interior lining wall 511, and a pocket space 510 therebetween. An interior dual-entry zipper 521A provides access to the pocket space 510 from the interior and an exterior dual-entry zipper 521B provides access to the same pocket space 510 from the exterior of the travel bag 100. FIG. 4 also shows a first series of flat pockets 320 stitched onto the interior lining wall 511. The flat pockets 320 are constructed to organize and securely hold certain electronic devices and other small items. In the particular embodiment shown, the first series of flat pockets 320 includes three pockets 322, 324, and 326, which are designed to carry, for example, a PDA, reading classes, and business cards. Ideally, the lining walls 511, 512, are padded with a padding material 513 to provide sufficient rigidity to prevent them from collapsing under the weight of the contents stored in the flat pockets 320. The padding may be a foam or other type of material that provides the desired rigidity.

FIG. 5 shows a second series of flat pockets 530 that is provided on the exterior lining wall 512 These flat pockets 530 are dimensioned to organize and securely hold certain items that are frequently needed when traveling, such as travel tickets and passport, cell phone, and sunglasses. In the embodiment shown, the second series of flat pockets includes three pockets 532, 534, and 536, which are intended to carry travel tickets, a cell phone, and sunglasses. Because the items carried in flat pockets 320 and 530 vary in size, they are ideally constructed of a rugged ,heavy-duty stretch material, such as a neoprene fabric. This material is sufficiently elastic to accommodate the variations in size among the various makes and styles of a PDA or cell phone, or the various travel tickets, for example, yet prevent them from slipping out of the pocket.

A zipper 521A/521B is provided in each of the lining walls 511 and 512, respectively, so that a user may reach straight through the dual-entry pocket 520 when both zippers 521A and 521B are unzipped. A dual-entry or secondary access 140 (shown in FIG. 1) is provided in the front wall 112, which provides access to the lining wall 511. This secondary access 140 may be a zipper hidden by an outer pocket, or simply en opening in a pocket on the outside of the front wall 112. The advantage of the secondary access 140 is that the user can access the contents in the dual-entry pocket 520 and in the second series of flat pockets 530, without having to use the primary access at the top of the travel bag 100. So, for example, the user, while carrying the travel bag 100 on her shoulder, can reach through the secondary access 140 into the flat pockets 532, 534, or 536, without having to release the retractable flap 130 and slide it back into the body 110.

Figure 6:
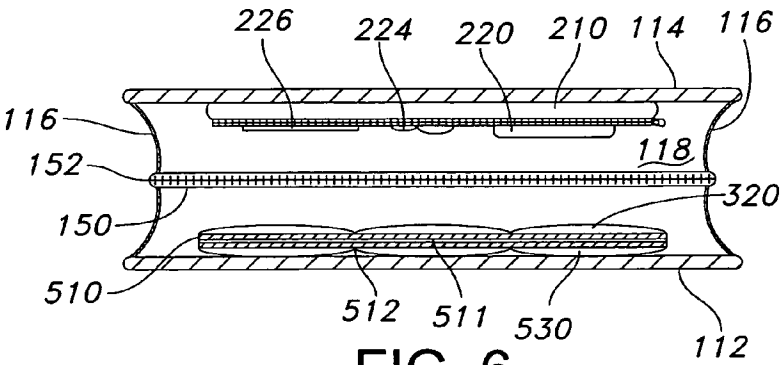
FIG. 6 is a cut-away top view of the travel bag, illustrating the arrangement of the computer compartment, the centrer zipper compartment, the dual-entry pocket and first and second series of flat pockets.

FIG. 6 is a top plane view in partial cross-section of the travel bag 100. In addition to the computer compartment 200 and the dual-entry pocket 520, with the various pockets 220, 320, and 530, a central storage area 150 with a zipper closure 152 Is also shown. This central storage area 150 is similar in construction to the dual-entry pocket 510, and is particularly practical in a travel bag that is a briefcase style.

Figure 7:
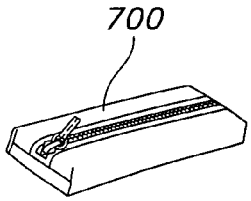
FIG. 7 is an illustration of a cord kit/tool kit.
Figure 8B:
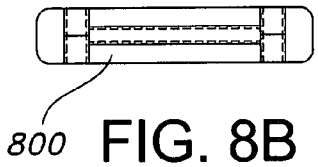
FIG. 8B shows the purse folded flat.
Figure 8A:
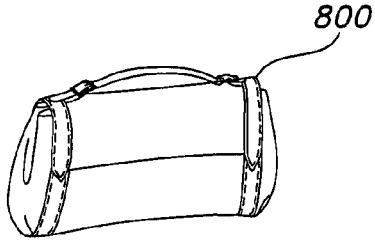
FIG. 8A is an illustration of a purse.

FIGS. 7, 8A, and 8B illustrate various accessory bags or kits that may be stored in the travel bag 100. FIG. 7 is an illustration of a tool kit 700. A cord kit is similar in construction to the tool kit 700, but with greater dimensions to provide adequate space to accommodate the power cords with DC adapters. FIGS. 8A and 8B illustrate a clutch-type purse 800 that folds flat when not in use and is easily stored in the travel bag 100. The purse 800 is large enough to hold a check-size wallet, a cell phone, and a few personal items such as makeup, lipstick, etc.

Figure 9:
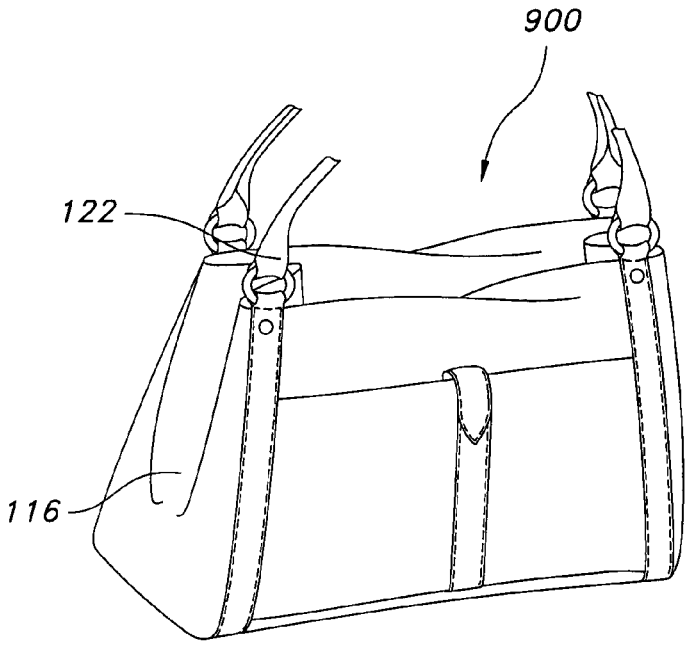
Figure 11:
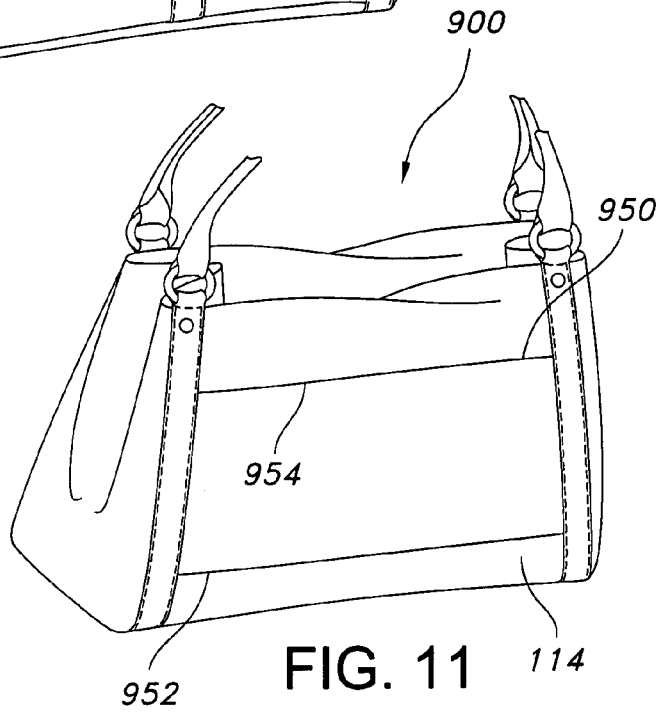
FIG. 11 is an illustration of the rear of the tote bag, showing the sleeve-pocket.
Figure 10:
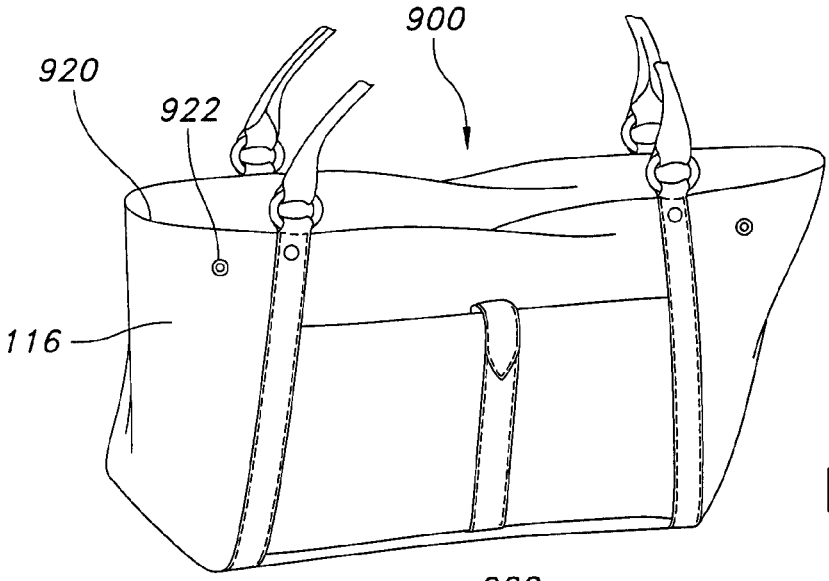
FIG. 10 is an illustration of the tote bag of FIG. 9, with the expandable gussets expanded.

FIGS. 9-13 illustrate a second embodiment of the travel bag 100 according to the invention that is styled as a tote bag 900. The tote bag 900 includes the computer compartment 200, the dual-entry pocket 510, the first series of flat pockets 320 and the second series of flat pockets 530 that are described above. Further provided in the tote bag 900 are expandable gussets 920 in the side walls 116 and deep pockets 930 that are provided in the expandable gussets 920. Gusset fasteners 922 may be provided in the side walls 116. When the extra space provided by the expandable gussets 920 is not needed, the gussets 920 are folded inward toward the interior of the tote bag 900 and snapped in place. This effectively reduces the overall length of the tote bag 900 by several inches, as shown in FIG. 9. Expanded gussets 920 are shown in FIG. 10.

Figure 13:
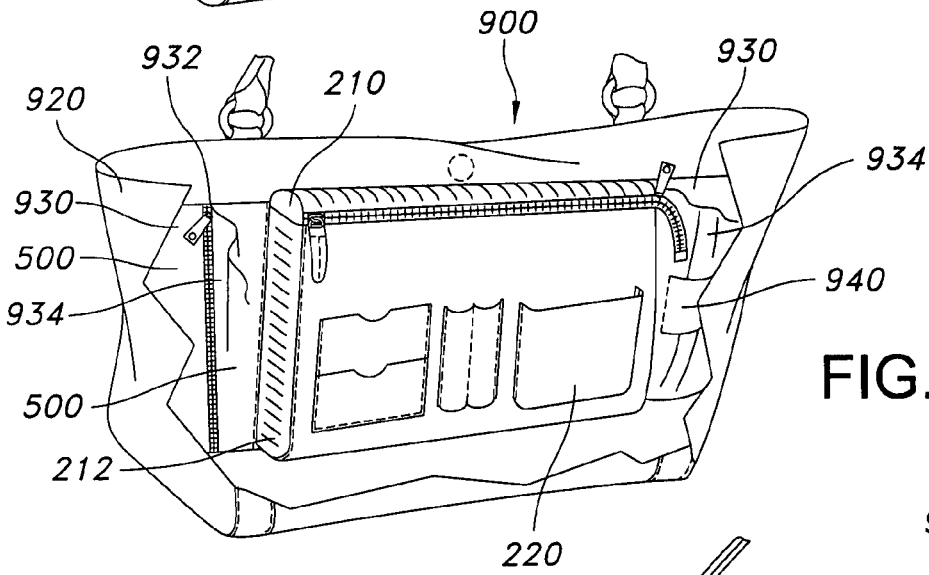
FIG. 13 is a partial cut-away view of the front wall of the tote bag, showing the computer storage compartment, the deep pockets, and the small pocket on the deep-pocket wall.
Figure 12:
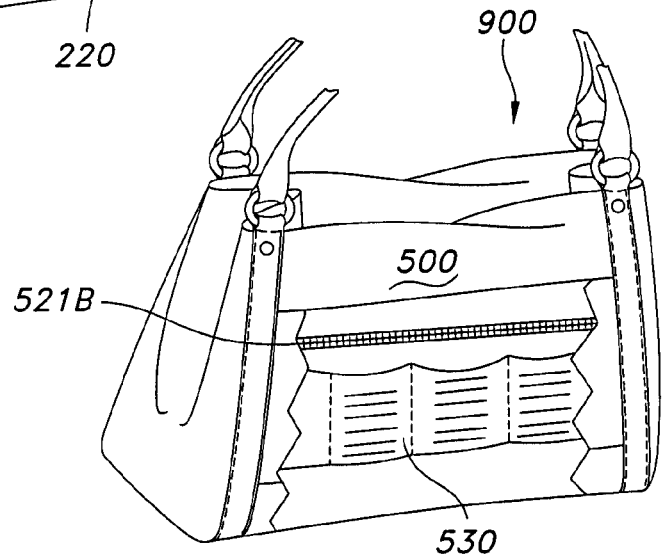
FIG. 12 is a partial cut-away view of the front wall of the tote bag, showing the dual entry pocket and second series of flat pockets.

FIGS. 12 and 13 are cut-away drawings that show various features in the interior of the tote bag 900. FIG. 12 shows the dual-entry pocket 510 with the first and second series of flat pockets 320, 520 arranged along the interior surface of the front wall 112 and FIG. 13 shows the computer compartment 200, with elastic side gussets 212 and pockets 220, arranged along the interior surface of the rear wall 114. FIG. 13 also shows the deep pockets 930 provided in the expandable gussets 920, with a removable deep pocket wall 934. The purpose of the deep pocket 930 is to provide a storage area separate from the central interior portion of the tote bag for holding items that are long and/or bulky and, for that reason, are inconvenient to store in a bag that has smaller items, and also for holding items that need to be kept separate from other items because they are wet. The deep pocket 930 is particularly adapted for storing, for example, a water bottle, an umbrella (even a wet one), or shoes, etc. In order to be able to accommodate rather large bulky items, however, the deep pocket 930 may be a hindrance and, thus, the deep-pocket wall 934 is removable by simply unzipping a deep-pocket zipper 932, thereby detaching one end of the deep-pocket wall 934 from the lining 500 and moving the loose wall, which is a supple piece of lining material, aside. A small pocket 940 is provided on the deep-pocket wall 934 for conveniently storing very small articles, such as a key chain.

FIG. 9 shows the front wall 112 of the travel bag 900, with a front wall pocket 960 and FIG. lithe rear wall 114, with a pocket-sleeve 950. The pocket-sleeve 950 has at least one zipper along the bottom pocket edge 952, and may also have a zipper along the top edge 954. When the bottom pocket edge 952 is closed, the pocket-sleeve 950 serves as a pocket, and when both bottom and top pocket edges 952, 954 are open, the pocket-sleeve 950 serves as a sleeve, which is used to secure the tote bag 900 to the pulled-out handle of a wheeled piece of luggage.

Figure 14:
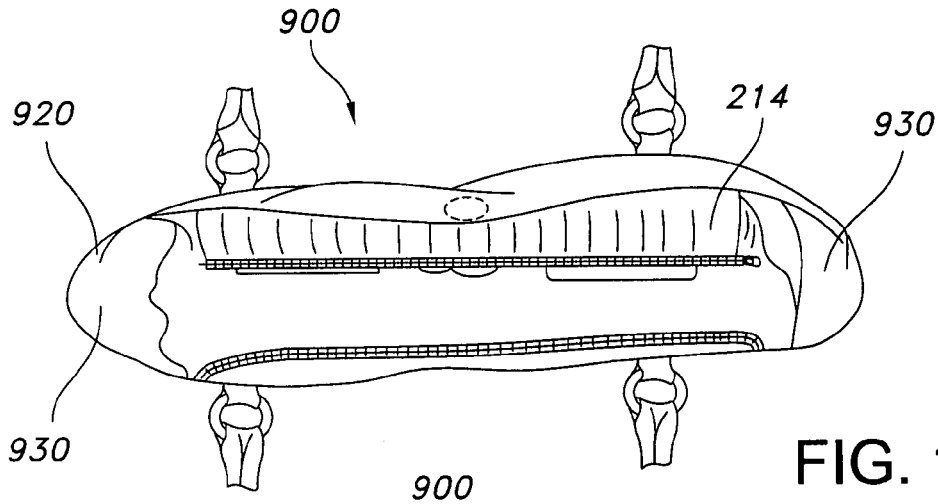
FIG. 14 is a top planar view of the tote bag showing the expandable cover closed over the computer compartment.
Figure 15:
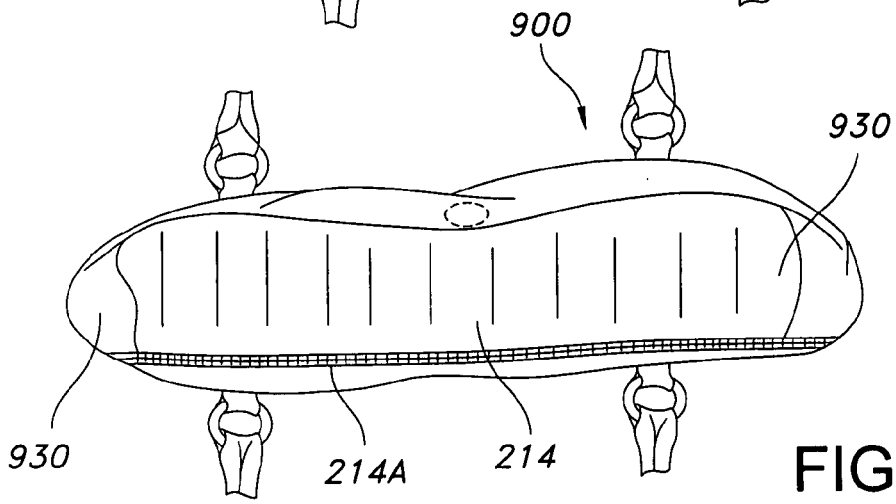
FIG. 15 is a top planar view of the tote bag showing the expandable cover closed over the top of the tote bag.
Figure 16:
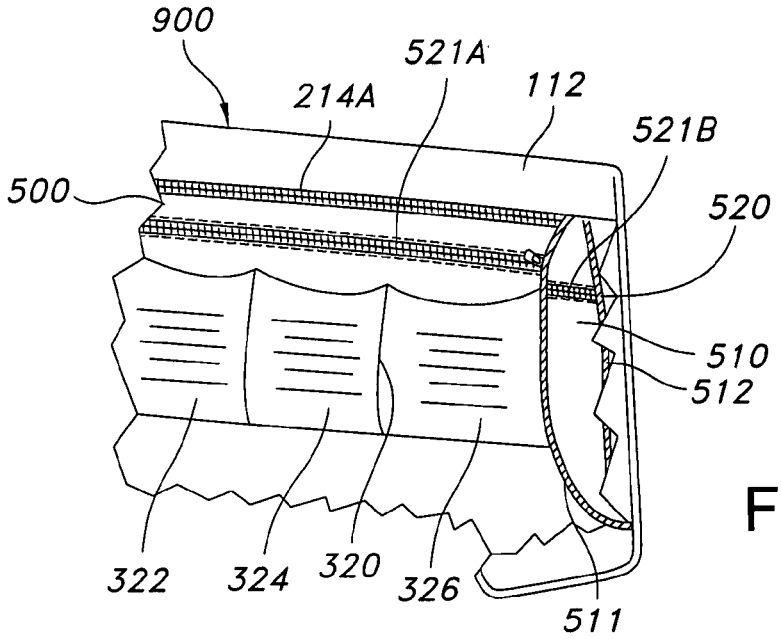
FIG. 16 is a partial cut-away view, showing the closure means on the inner wall of the dual-entry pocket, for closing the expandable cover as shown in FIG. 15.

FIGS. 14-16 illustrate an expandable cover 214 that serves to secure the computer compartment 200 and also to close off the top of the tote bag 900 FIG. 14 shows the travel bag 900 with the expandable cover 214 closed over the computer compartment 200, whereby the remaining portion of the inner area of the bag remains accessible from the top. FIG. 15, also a top planar view, shows the expandable cover 214 extended across the top area of the tote bag 900 and attached to the inner lining wall 511 of the dual-entry pocket 510. Although various types of closure means may be used, the preferred means of closing the expandable compartment cover 214 over the computer compartment 200, as well as over the top area of the tote bag 900 is with a zipper. FIG. 16 shows a zipper receiver 214A that is provided on the inner lining wall 511 above the zipper 521A for the dual-entry pocket 510. When the expandable cover 214 is secured against the inner lining wall 511, the contents of the bag are protected from the weather, prying eyes, and accidental spillage, should the bag fall over. This is particularly advantageous when traveling or when having to stow the bag out of the immediate vicinity of the owner. The material used for the expandable cover 214 may be any expandable material, such as stretchy or pleated materials. Stretchy materials are particularly suitable, as they will not provide excessive bulk when the expandable cover 214 is open or extends over only the computer compartment 200. Ideally, the material is also waterproof, or at least water-resistant. A particularly suitable material is the neoprene fabric mentioned above, because of its durability, expandability, water resistance, and aesthetically pleasing texture and appearance.

As mentioned above, the body of the travel bag 100 or 900 may be made of any number of suitable fabrics, including leather, canvas, other rugged and durable natural and synthetic fabrics, or a combination thereof. In a highly fashionable travel bag 100 or 900, particularly one in the briefcase style, the body 110, the retractable flap 130, and the wall of the computer compartment 200 may be made of high-grade leather. The body 110 is lined with the supple lining material 500, which preferably is tear-resistant, water-repellent and mildew-resistant. Ideally, the lining material 500 is of a light color, which makes it easier to see into the interior of the travel bag.

The carrying means 120 in the embodiment of the travel bag 100 shown in FIG. 1 is a set of straps 122. Preferably, the straps 122 are rope-filled tubular leather straps that are comfortable to grip and are also comfortable to wear on the shoulder, but other means such as flat straps may also be used. Whatever the type of the carrying means 120, they are preferably adjustable in length to accommodate a wide range of heights of users. The straps 122 may wrap around the body 110, that is, flat strap extensions are stitched down along the outer front and rear walls and across the bottom of the body, to increase the carrying strength of the bag, as shown in FIGS. 1 and 9. In the tote bag style 900, the ends of the straps 122 are attached to the corners of the body 110 as defined when the expandable gussets 920 are folded in, as shown in FIG. 9.

It is understood that the embodiments described herein are merely illustrative of the present invention. Variations in the construction of the travel bag may be contemplated by one skilled in the art without limiting the intended scope of the invention herein disclosed and as defined by the following claims.

What is claimed is:

1. A travel bag comprising a body having a first wall and a second wall, two sidewalls, a top and a bottom, said body encompassing a central storage area with a primary access to said central storage area from said top of said body;

a computer compartment having a rear compartment wall, an outer compartment face, and sides, each side extending between an end of said outer compartment face and said rear compartment wall;

wherein said computer compartment has an expandable closable top with closure means for securing any contents within said compartment; and wherein said closure means is selectively attachable to said outer compartment face or to said second wall.

2. The travel bag of claim 1, wherein said expandable top is made of a stretch material that includes polychloroprene synthetic rubber.

3. The travel bag of claim 1, further comprising a dual-entry pocket formed along an inner surface of said second wall, wherein said dual-entry pocket has two dual-entry-pocket faces, a first dual-entry-pocket face and a second dual-entry-pocket face, wherein a first pocket opening is provided in said first dual-entry-pocket face and a second pocket opening provided in said second dual-entry-pocket face, so as to provide access to an internal dual-entry pocket area from each of said two dual-entry pocket faces.

4. The travel bag of claim 3, wherein said dual-entry pocket is a rectangular pocket, and wherein all four edges of said first dual-entry-pocket face are joined to all four corresponding edges of said second dual-entry-pocket face.

5. The travel bag of claim 3, wherein said second wall of said body has a secondary-access opening that provides access to said second pocket opening, and wherein said secondary access opening provides access to said internal dual-entry-pocket area through said second wall from outside said body.

6. The travel bag of claim 3, further comprising a series of flat pockets provided along said second wall.

7. The travel bag of claim 6, wherein said series of flat pockets includes a first series of flat pockets that is provided on said first dual-entry-pocket face of said dual-entry pocket, said first dual-entry-pocket face facing inward towed said central storage area.

8. The travel bag of claim 6, wherein said series of flat pockets is constructed of a stretch material.

9. The travel bag of claim 8, wherein said stretch material includes polychloroprene synthetic rubber.

10. The travel hag of claim 1, further comprising an expandable gusset in at least one sidewall of said two sidewalls and a deep pocket in said expandable gusset, wherein said expandable gusset is expandable to an expanded configuration in which said sidewall is extended outward to open up said deep pocket or foldable to a folded configuration in which said sidewall is folded inward toward said central storage area of said body.

11. The travel bag of claim 10, wherein said deep pocket is formed by a detachable deep-pocket wall that is removably attachable to at least one of said walls of said body.

12. The travel bag of claim 1, wherein one or more pockets are provided on said outer compartment face.

13. The travel bag of claim 1, further comprising a central file pocket with a zipper closure, said central file pocket extending substantially parallel to and between said computer compartment and said second wall.

14. The travel bag of claim 1, further comprising travel bag carrying means that are attached to said body.

15. The travel bag of claim 14, wherein said computer compartment sides are constructed of a stretch material that includes polychloroprene synthetic rubber.

* * * * *